US009156528B2

(12) United States Patent
Jesewitz

(10) Patent No.: US 9,156,528 B2
(45) **Date of Patent: *Oct. 13, 2015**

(54) HEIGHT ADJUSTABLE CARGO RACK APPARATUS AND TOWER FOR WAKEBOARD BOATS

(71) Applicant: Raymond L. Jesewitz, Longwood, FL (US)

(72) Inventor: Raymond L. Jesewitz, Longwood, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/501,033

(22) Filed: Sep. 30, 2014

(65) Prior Publication Data

US 2015/0014379 A1 Jan. 15, 2015

Related U.S. Application Data

(63) Continuation-in-part of application No. 13/967,137, filed on Aug. 14, 2013, now Pat. No. 9,038,875, which is a continuation-in-part of application No. 13/214,149, filed on Aug. 19, 2011, now Pat. No. 8,567,651, which is a continuation-in-part of application No. 11/711,282, filed on Feb. 27, 2007, now Pat. No. 8,025,194, said application No. 13/214,149 is a continuation-in-part of application No. 13/180,542, filed on Jul. 11, 2011, now Pat. No. 8,297,484.

(60) Provisional application No. 60/777,060, filed on Feb. 27, 2006.

(51) Int. Cl.

| | |
|---|---|
| ***B63B 17/00*** | (2006.01) |
| ***B63B 25/00*** | (2006.01) |
| ***B63B 25/18*** | (2006.01) |
| *B63B 35/79* | (2006.01) |

(52) U.S. Cl.

CPC ..... *B63B 25/18* (2013.01); *B63B 25/002* (2013.01); *B63B 17/00* (2013.01); *B63B 25/00* (2013.01); *B63B 35/7946* (2013.01)

(58) Field of Classification Search

CPC .. B63B 25/002; B63B 25/18; B63B 35/7946; B63B 35/815

USPC ..... 224/406, 274, 405, 311, 280, 401, 282, 224/548, 549, 553; 114/343, 364

See application file for complete search history.

(56) References Cited

U.S. PATENT DOCUMENTS

| | | | | |
|---|---|---|---|---|
| 3,049,273 | A * | 8/1962 | Crane | 224/311 |
| 4,424,907 | A * | 1/1984 | Robb | 211/70.8 |
| 6,327,993 | B1 * | 12/2001 | Richens, Jr. | 114/361 |
| 6,439,150 | B1 * | 8/2002 | Murphy et al. | 114/361 |
| 6,572,168 | B1 * | 6/2003 | Radstake | 312/247 |
| 6,799,529 | B1 * | 10/2004 | Willis | 114/361 |
| 7,392,758 | B2 * | 7/2008 | Metcalf | 114/361 |
| 7,401,569 | B2 * | 7/2008 | Jones | 114/361 |

(Continued)

*Primary Examiner* — Justin Larson

(74) *Attorney, Agent, or Firm* — Paul Royal, Jr.; The Patent Guild

(57) ABSTRACT

A height adjustable cargo rack apparatus and tower and for wakeboard boats and the like, the apparatus including: a tower base rigidly attached to a boat gunwale, vertical supports extending from the tower base and pivotally operable; a pivotally adjustable cargo rack apparatus supported by the vertical supports; and, a height adjustable upper tower section which is pivotally supported by the vertical supports and which adjustably supports the cargo rack apparatus. The multiplicity of adjustable and pivotal features work in conjunction with each other to maximize the unique functionality of the instant apparatus.

20 Claims, 18 Drawing Sheets

(56) References Cited

U.S. PATENT DOCUMENTS

| | | | | |
|---|---|---|---|---|
| 7,418,918 | B2 * | 9/2008 | Bierbower et al. | 114/361 |
| 7,571,691 | B2 * | 8/2009 | Russikoff | 114/361 |
| 7,895,964 | B2 * | 3/2011 | Russikoff | 114/361 |
| 8,025,194 | B2 * | 9/2011 | Jesewitz | 224/406 |
| D649,505 | S * | 11/2011 | O'Dell | D12/317 |
| 8,205,571 | B1 * | 6/2012 | Rondeau et al. | 114/361 |
| 8,297,484 | B2 * | 10/2012 | Jesewitz et al. | 224/406 |
| 8,522,709 | B2 * | 9/2013 | Williams et al. | 114/361 |
| 8,567,651 | B2 * | 10/2013 | Jesewitz | 224/406 |
| 8,905,281 | B2 * | 12/2014 | Jesewitz | 224/406 |

* cited by examiner

HEIGHT ADJUSTABLE CARGO RACK APPARATUS AND TOWER FOR WAKEBOARD BOATS

CROSS REFERENCE TO RELATED APPLICATIONS

This application is a Continuation-In-Part of U.S. patent application Ser. No. 13/967,137, filed Aug. 14, 2013 which claims the benefit of U.S. patent application Ser. No. 13/214,149, filed Aug. 19, 2011, and issued as U.S. Pat. No. 8,567,651 which claims the benefit of U.S. patent application Ser. No. 11/711,282, filed Feb. 27, 2007, and issued as U.S. Pat. No. 8,025,194 which claims the benefit of U.S. Provisional Patent Application No. 60/777,060, filed Feb. 27, 2006 wherein all applications are incorporated by reference in their entirety as if fully set forth herein. Further, this application claims the benefit of U.S. Provisional Patent Application No. 61/363,259 filed Jul. 11, 2010, which claims the benefit of U.S. Provisional Patent Application Ser. No. 61/323,005, filed Apr. 12, 2010, wherein both provisional applications are incorporated by reference in their entirety as if fully set forth herein. Additionally this application claims the benefit of U.S. patent application Ser. No. 13/180,542, filed Jul. 11, 2011, and issued as U.S. Pat. No. 8,297,484.

FIELD OF THE INVENTION

The present invention relates generally to boating equipment and accessories, and more particularly to an improved height adjustable cargo rack apparatus and tower for wakeboard boats and the like.

BACKGROUND OF THE INVENTION

It is a truism among boating enthusiasts that there is never enough storage room on a boat. This is particularly true in wakeboarding and related water sports, where the boater may need a place to store wakeboards, surfboards, wakesurf boards, tubes, inflatables, kayaks, accessories, and/or other sport cargo.

U.S. Pat. No. 6,192,819 to Larson, et al. discloses a water sport towing apparatus. U.S. Pat. No. 5,752,638 to Meeks describes a combination water ski and wake board rack. United States Patent Application 20020053313 by Murphy, et al. teaches a shade cover assembly adapted to be carried on a tower above the cockpit area of a pleasure boat.

Reference to, and discussion of, the foregoing patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

SUMMARY OF THE INVENTION

The present invention provides an improved height adjustable cargo rack apparatus and tower for wakeboard boats and the like. The inventive apparatus enables the adjustability of the height of the cargo rack/bimini which is accomplished while maintaining the functionality of independently lowering or raising the lower tower section such as manually or with an actuator, gas spring, or tensioner cable after releasing a locking mechanism. The range in height would be approximately 20", adjustable from 50" to 70" as measured at the front of the rack to the floor of the boat. The benefit to the user is the ability to control the amount of shade/sun for the people in the general cockpit area. It also allows a user to achieve a higher walk-through height for ease of maneuvering in the boat. Generally there is a trade off between the amount of sun coverage and height of the bimini portion of the rack. This feature allows the user to easily adjust the height to his/her liking.

It is therefore an object of the present invention to provide a new and improved height adjustable cargo rack apparatus and tower for wakeboard boats and the like.

Other novel features which are characteristic of the invention, as to organization and method of operation, together with further objects and advantages thereof will be better understood from the following description considered in connection with the accompanying drawing, in which preferred embodiments of the invention are illustrated by way of example. It is to be expressly understood, however, that the drawing is for illustration and description only and is not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the national patent office(s) and the public generally, and especially the scientists, engineers and practitioners in the art who are not familiar with patent or legal terms or phraseology, to determine quickly from a cursory inspection the nature and essence of the technical disclosure of the application.

The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE EMBODIMENTS

As disclosed herein, essential elements of the height adjustable cargo rack apparatus and tower include, but are not limited to: a tower base rigidly attached to a boat gunwale, the tower base may include a powered actuator; vertical supports extend from the tower base and manually pivotally operate or pivotally operate by via the powered actuator; a height adjustable upper tower section which is pivotally supported by the vertical supports, wherein the height adjustable upper tower section may adjustably support the cargo rack apparatus; a pivotally adjustable cargo rack apparatus supported by the vertical supports or by the height adjustable upper tower section.

As described below, the multiplicity of adjustable and pivotal features work in conjunction with each other to maximize the unique functionality of the instant apparatus.

While the preferred cargo rack apparatus is presented herein, it is understood alternate embodiments may encompass cargo racks differently configured or bimini tops (such as collapsible or welded frame bimini tops) as generally used within the industry. While these alternate cargo rack apparatus embodiments may present elements of the instant invention, it is understood that they are not necessarily the equivalent to the cargo rack of the preferred embodiment of the instant invention or of the height adjustable cargo rack apparatus and tower of the instant invention.

Height Adjustable Tower

More particularly, as shown at least in FIG. 1-12*c*, the height adjustable cargo rack apparatus and tower 100 includes at least one wakeboard tower 114 and tower mount 190 wherein the tower mount 190 is pivotally connected to a tower base 195.

Figure 1:
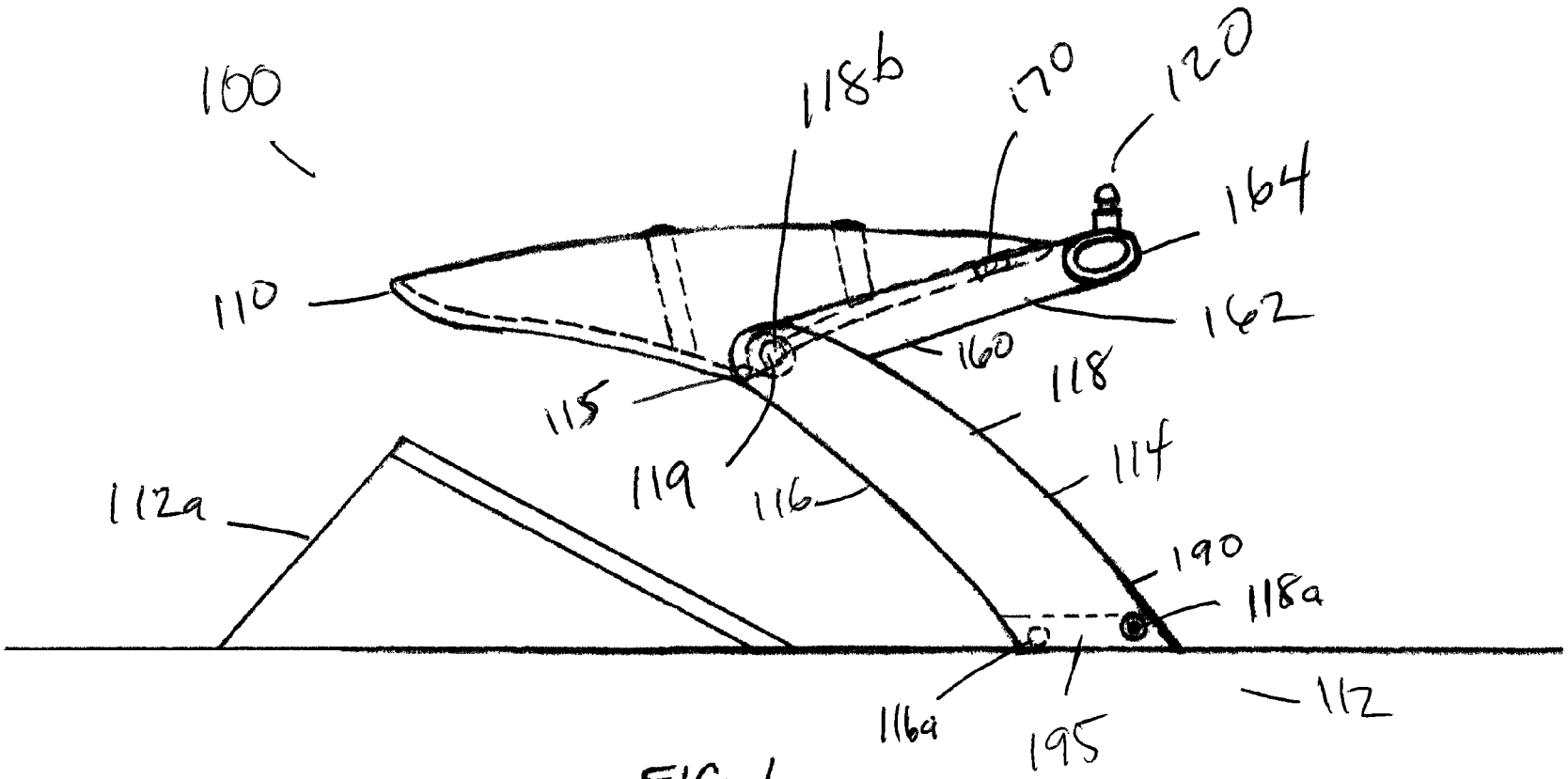
FIG. 1 is a side view of a preferred embodiment of the instant invention.

As shown in FIG. 1, the preferred embodiment of the present invention includes a wakeboard tower 114 connected to a tower mount 190 which is connected to a tower base 195 which itself is connected to a boat 112 gunwale at the port side of the boat and a wakeboard tower 114 connected to a tower mount 190 which is connected to a tower base 195 which itself is connected to a boat 112 gunwale at the starboard side of the boat.

Note—whereas tower bases 195, tower mounts 190, and towers 114 are respectively symmetrical with the exception that they are designed for their specific port or starboard location on the boat, within the present application they (both sides of the boat) are respectively designated tower base 195, tower mount 190, and tower 114 as applicable and only one side view is shown of the respectively symmetrical side views unless noted otherwise.

As shown at least in FIG. 1-FIG. 4, each wakeboard tower 114 includes a forward vertical support 116 pivotally connected to the tower mount 190 at forward pivot joint 116*a*, and an aft vertical support 118 which is releasably connected to both the upper rear of the housing of tower base 195 and to tower mount 190 at aft release joint 118*a*. The forward vertical support 116 and aft vertical support 118 are connected together in each tower 114.

The tower base 195 may include a base actuator (not shown) [such as the base actuator of U.S. Pat. No. 8,297,484 which is incorporated herein by reference] extendably and retractably attached at portion of the tower mount. The base actuator of the preferred embodiment is an electromechanical actuator however it is understood the actuator may, for alternative embodiments, be of an alternative type such as a hydraulic actuator, an electro-hydraulic, a pneumatic actuator, a electro-pneumatic actuator, or gas spring, or similar displacement producing component.

The tower base 195 may also include a base locking mechanism (not shown) such as the base locking mechanism of U.S. Pat. No. 8,297,484 which is incorporated herein by reference.

A unique feature of the base locking mechanism is that it can be unlocked to allow the tower 114 to be tilted about forward pivot joint 116*a* and re-locked once the tower 114 is in the desired position.

Figure 6:
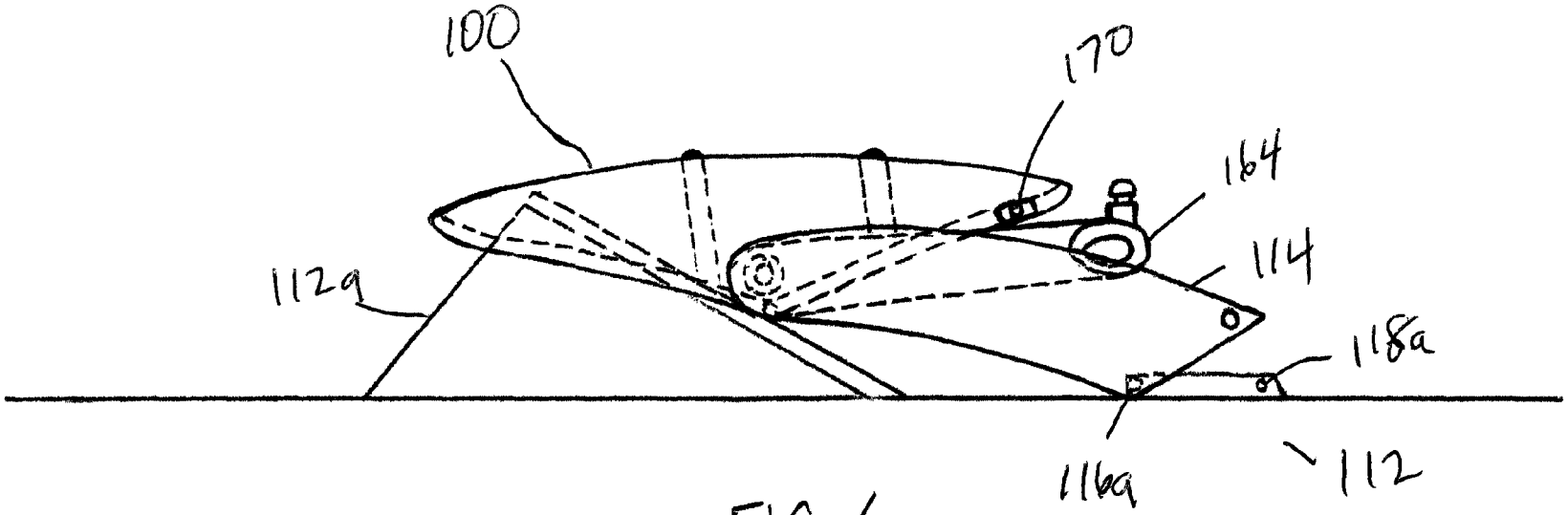
FIG. 6 is a side view of FIG. 1 with the cargo rack and tower folded down.

The tower 114 can be tilted about forward pivot joint 116*a* to allow the tower 114 to be folded down against the boat windshield 112*a* into a stowed position as shown in FIG. 6.

Tower Height Adjustment Operation

FIG. 1 thru FIG. 6 shows a first embodiment of the height adjustable cargo rack apparatus and tower 100 as it moves from the fully extended position, FIG. 1, to the retracted and stowed position, FIG. 6. When the wakeboard towers 114 are in the maximum upright position, the upper ends of the wakeboard towers 114 are at their furthest distance from the gunwale of the boat 112. The base locking mechanism of the tower base 190 is locked to hold the wakeboard towers 114 in the maximum upright position.

With the release of the base locking mechanism on each of the two tower bases 195 the lower section of each tower 114 can be pivoted about forward pivot joint 116*a* to allow each tower 114 to tilt forward and downward towards the gunwale of the boat 112.

The movement of each tower 114 maybe also determined by operation of the base actuator.

Figure 2:
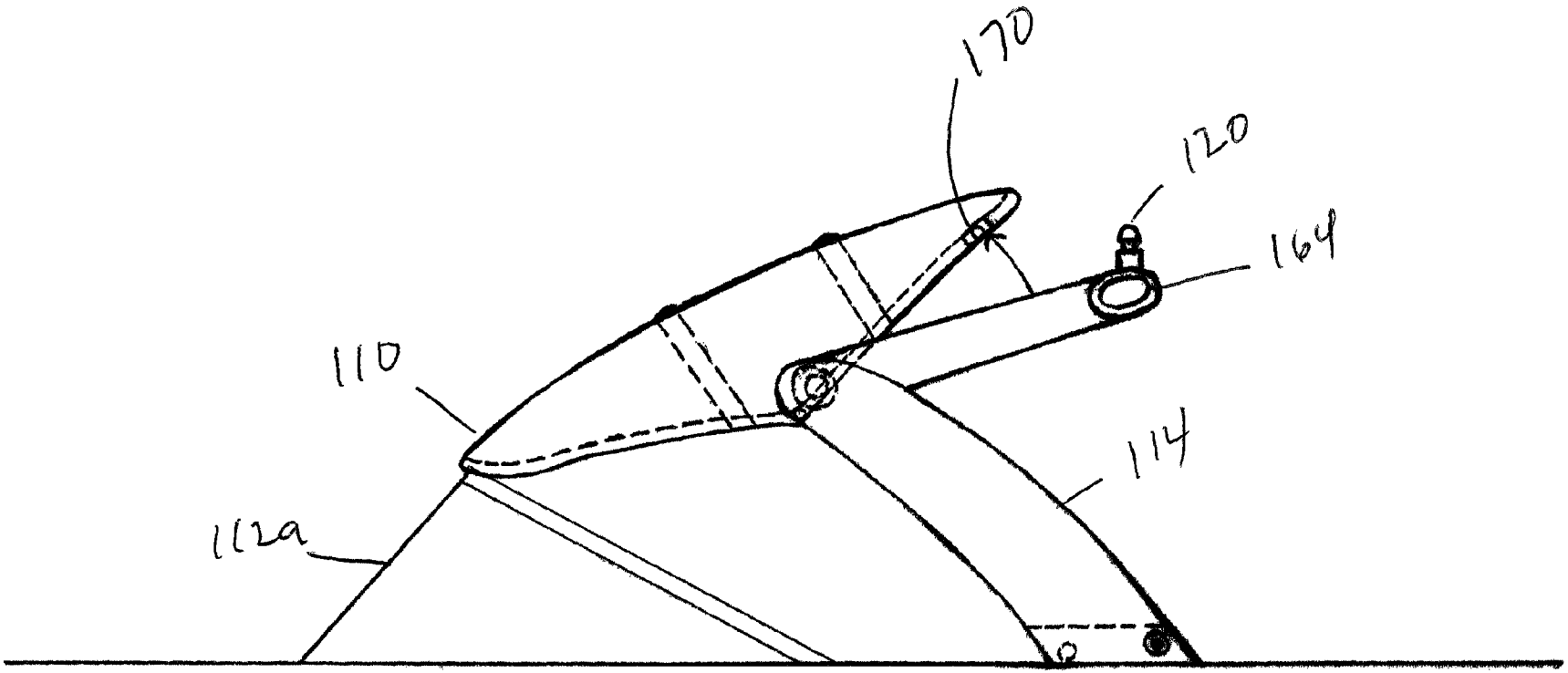
FIG. 2 is a side view of FIG. 1 with the cargo rack tilted.
Figure 3:
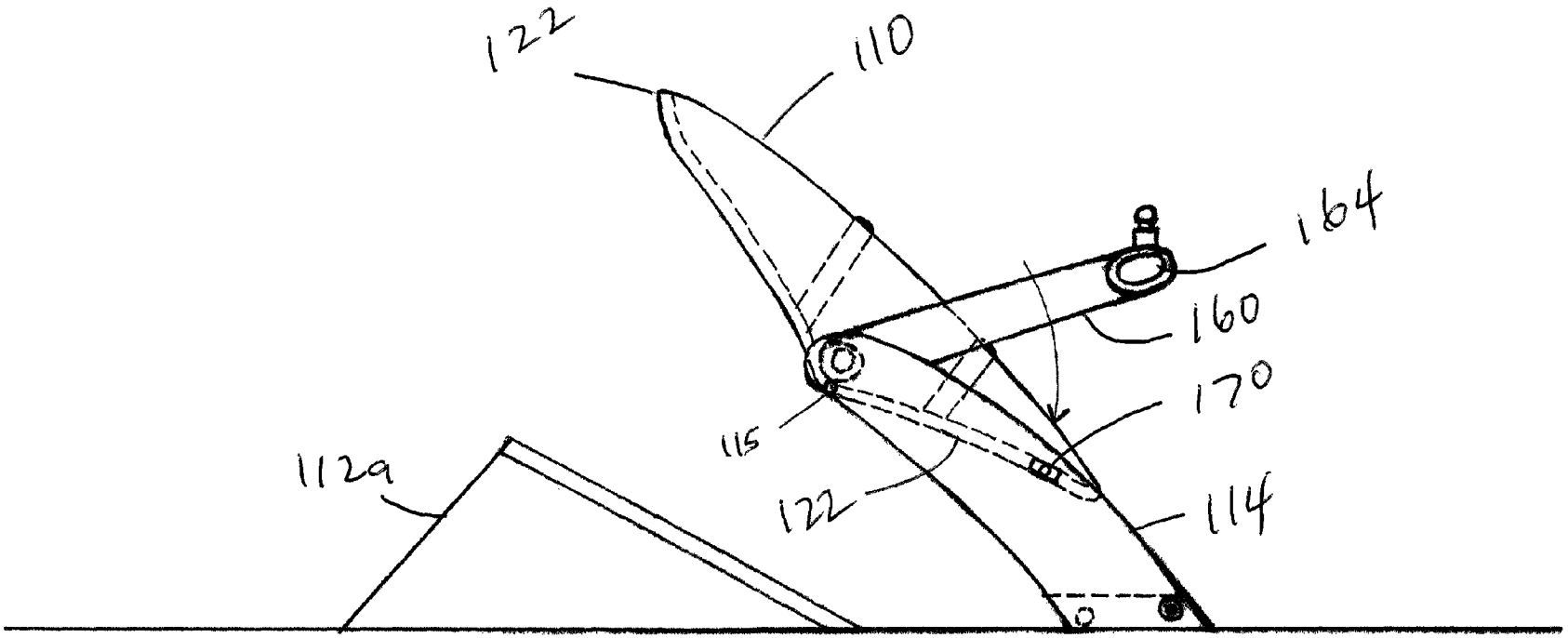
FIG. 3 is a side view of FIG. 1 with the cargo rack tilted.

The placement of the forward pivot joint 116*a* at the upper front of the tower base 195, as shown in at least in FIG. 1-FIG. 3, is an essential element in the pivotal movement of the tower 114. This optimized location of forward pivot joint 116*a* allows the vertical support 116 to pivot down with minimal forward movement of the overall cargo rack apparatus 110.

Height Adjustable Cargo Rack Preferred Embodiment

As shown at least in FIG. 1 of the preferred embodiment, the height adjustable cargo rack apparatus and tower of the instant invention further includes a cargo rack apparatus 110 supported by the upper ends of both the forward vertical support 116 and the aft vertical support 118 near a midsection 119 of each tower 114 [such as the cargo rack of U.S. Pat. No. 8,297,484 which is incorporated herein by reference].

Figure 4:
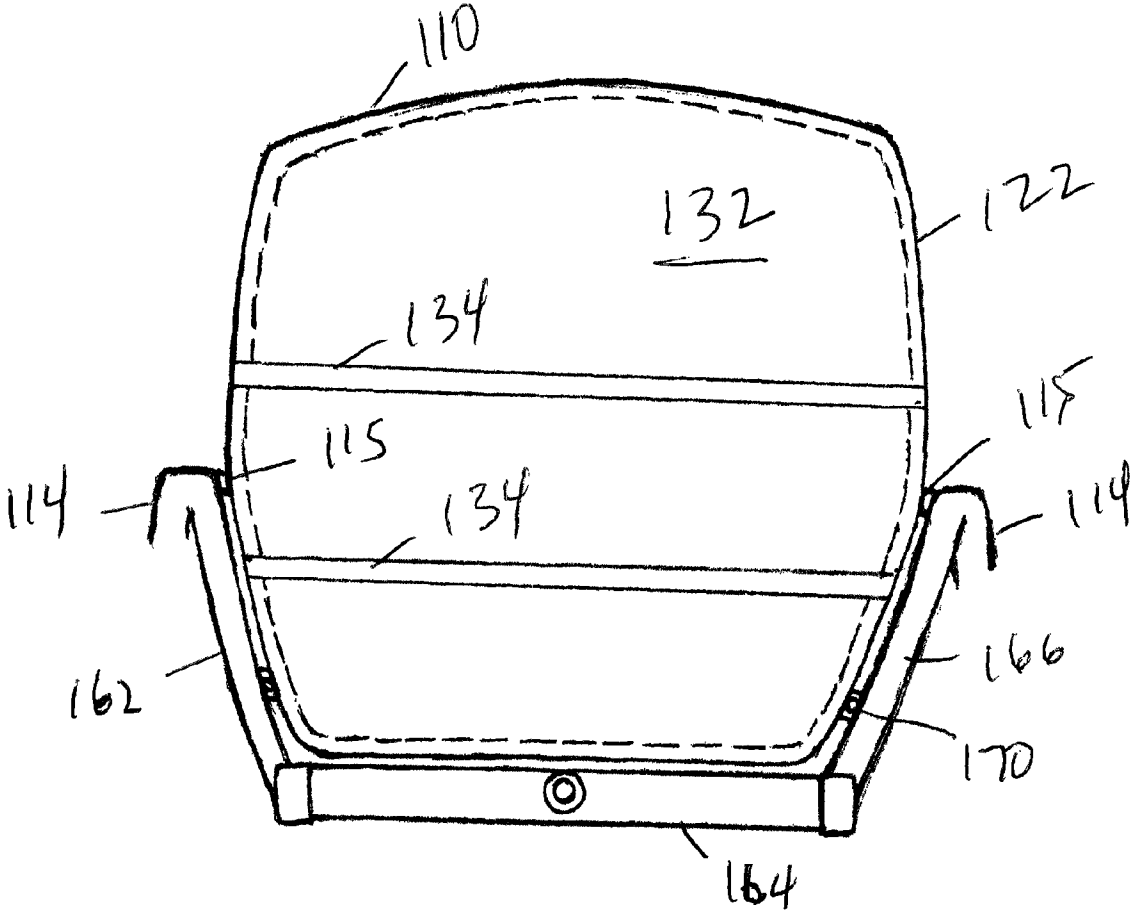
FIG. 4 is a top view of FIG. 1.

As shown at least in FIG. 4, the cargo rack apparatus 110 includes a cargo rack apparatus interior volume 132, and one or more connected peripheral rail 122.

Cargo rack apparatus 110 may optionally include at least one crossmember 134, interconnecting portions of the peripheral rail 122 and also cooperates to provide a support surface for stored items. Cargo rack apparatus 110 may optionally be a hardtop cover with or without at least one crossmember 134.

As shown at least in FIG. 4, the cargo rack apparatus 110 is pivotally, releasably, and adjustably attached to each tower midsection 119.

As also shown at least in FIGS. 1-4, the height adjustable cargo rack apparatus and tower 100 of the instant invention further includes an upper tower section 160 supported by the upper ends of both the forward vertical support 116 and the aft vertical support 118 near the midsection 119 of each tower 114.

As shown in FIG. 4, the upper tower section 160 includes interconnected peripheral rails defining an upper tower section port side wall 162, an upper tower section back wall 164, and an upper tower section starboard side wall 166.

The upper tower section port side wall 162 and the upper tower section starboard side wall 166 are adjustably attached to each respective tower midsection 119 at fore pivot joint 118*b* as further described below.

Fore pivot joint 118*b* pivotally and lockably connects the tower midsection 119 to the upper tower section port side wall 162 and the upper tower section starboard side wall 166 at fore pivot joint 118*b*.

Specifically, the intersecting plane and interconnection formed by each tower's midsection 119, the upper tower section port side wall 162 and the upper tower section starboard side wall 166, establishes the position of a pair of coplanar fore pivot points defined herein as fore pivot joint 118*b*, as shown at least in FIG. 1 (note only 1 fore pivot point 118*b* is shown with respect to one tower 114 and it is understood the corresponding tower 114 on the side of the boat not shown provides a corresponding second fore pivot point 118*b*). The fore pivot points 118*b* are also referred to herein as the tower pivot joint 150.

The one or more peripheral rail 122 of the cargo rack apparatus 110 pivots about cargo rack pivot point connector(s) 115 near the midsection 119 of each tower 114 and within an area bounded by the two towers 114 and the upper tower section back wall 164.

Additionally, the cargo rack apparatus 110 may also include locking mechanisms 170 to securely hold the cargo rack apparatus 110 in a desired position relative to the upper tower section 160. It is understood the locking mechanisms 170 may include magnetic segments, latches, pins, tabs, protrusions, and similar such fastening elements. Further it is understood a companion interlocking component of the locking mechanisms 170 may be provided on the upper tower section 160.

The cargo rack pivot point connectors 115 may include magnetic segments, hinges, pins, tabs, protrusions, ball and socket, and similar such pivoting and fastening elements. Further it is understood a companion interlocking component of the cargo rack pivot point connectors 115 may be provided on the tower 114 at a variety of locations.

The height adjustable cargo rack apparatus and tower of the instant invention may include a gas spring, 175*a* (FIG. 8), or 175*b* (FIG. 12*d*) may be used to assist with the movement of the cargo rack apparatus 110 and/or tower 114.

Cargo Rack Height Adjustment Operation

In this preferred embodiment, the cargo rack apparatus 110 adjustably pivots upward and downward about the fore pivot points 118*b* thereby providing a variation in the height of the cargo rack apparatus.

The fore and aft as well as upward and downward rake motion range of the cargo rack apparatus 110 as it pivots about the cargo rack pivot point connectors 115 provides the ability to adjust the effective height of the cargo rack apparatus 110 which allows user to control the amount of coverage from the harmful rays of the sun which can cause skin cancer or to protect boaters from wind and rain. Further, this unique range of movement of the cargo rack apparatus 110 allows users to adjust the bow-to-stern walk-through height as desired.

The tilting of the lower section of each tower 114 controls the height of the cargo rack apparatus 110 and can be adjusted in coordination with the tilting of the tower 114 or the cargo rack apparatus 110 can be tilted independently of the tilting of the tower 114.

Figure 5:
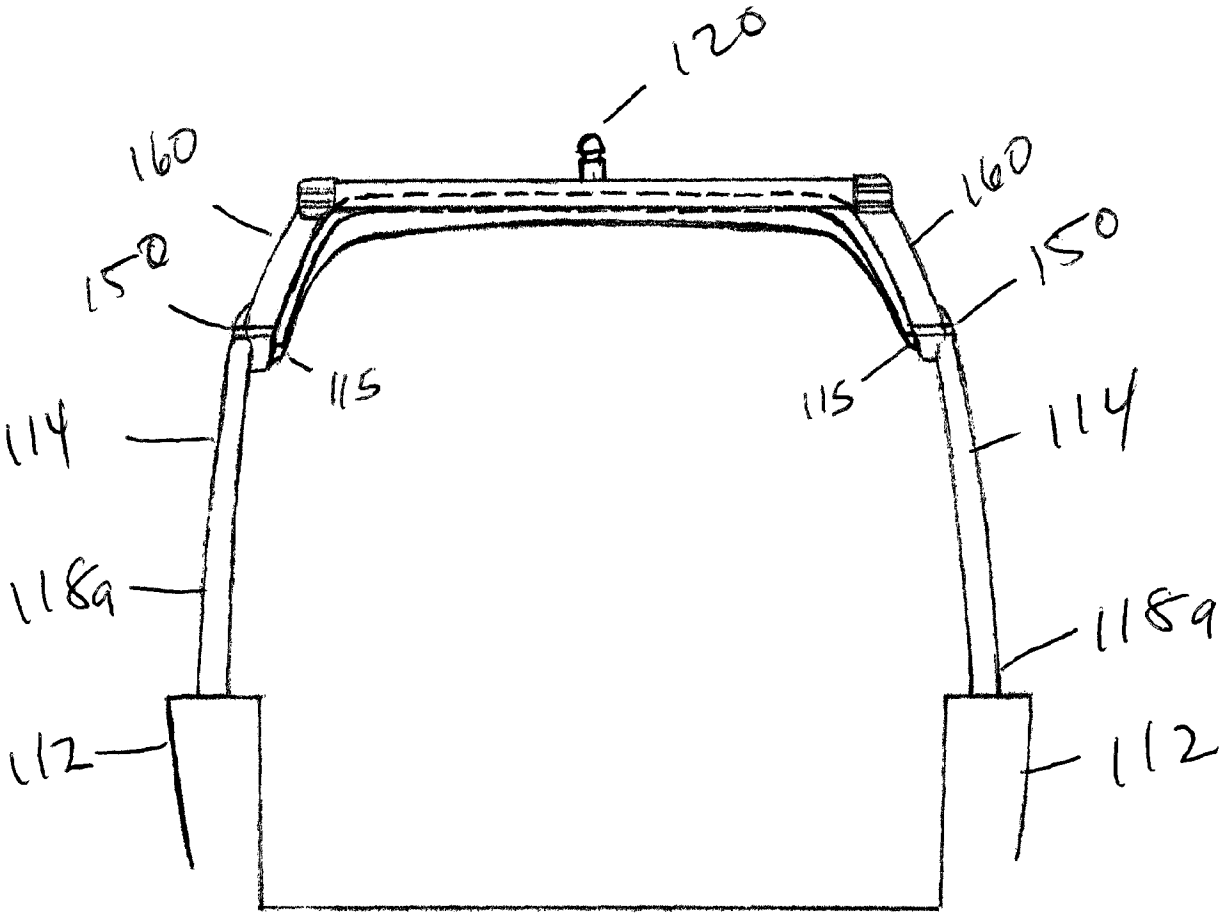
FIG. 5 is a rear view of FIG. 1.

As shown in FIG. 3, the with the fore portion of the peripheral rail 122 of the cargo rack apparatus 110 at its maximum height, the aft portion of the peripheral rail 122 swings within the inboard area of each tower 114 and within the inboard area of the upper tower section back wall 164. Overall, as shown in FIG. 4 and FIG. 5, in the preferred embodiment the cargo rack apparatus 110 is positioned and pivots inboard of each tower 114 and the upper tower section back wall 164.

Height Adjustable Cargo Rack First Alternate Embodiment

Figure 7:
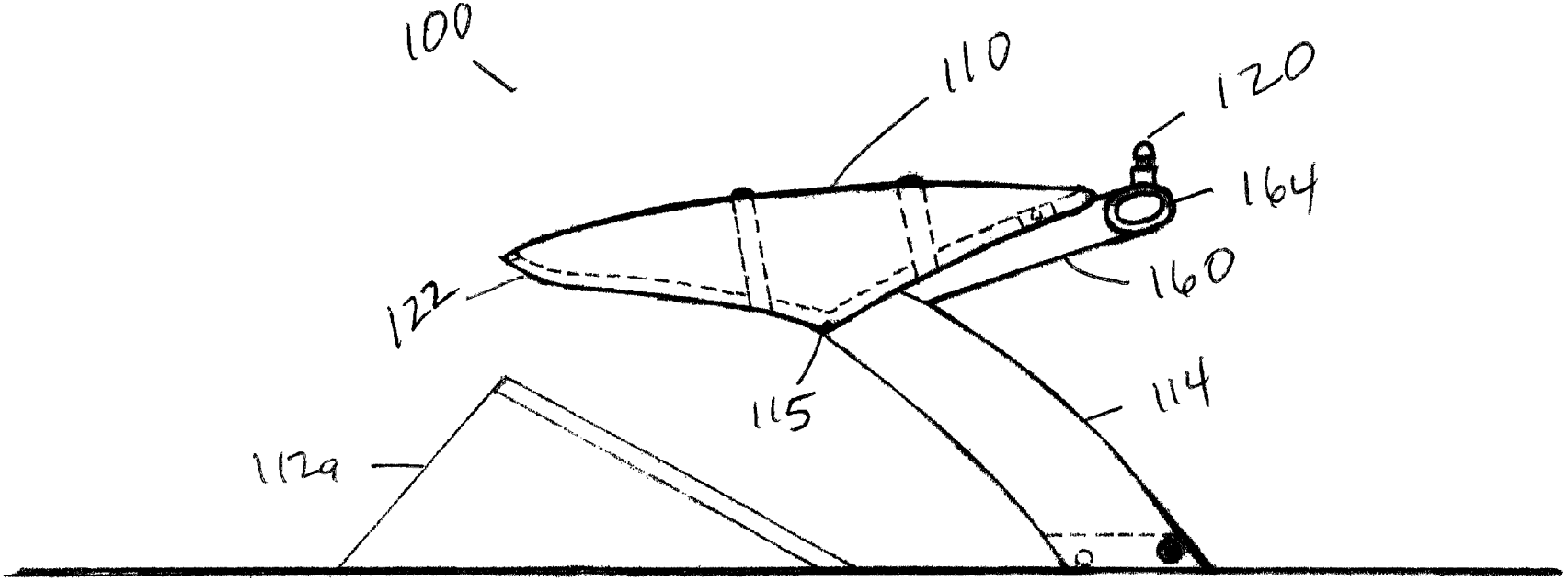
FIG. 7 is a side view of a first alternate embodiment of the instant invention.
Figure 7A:
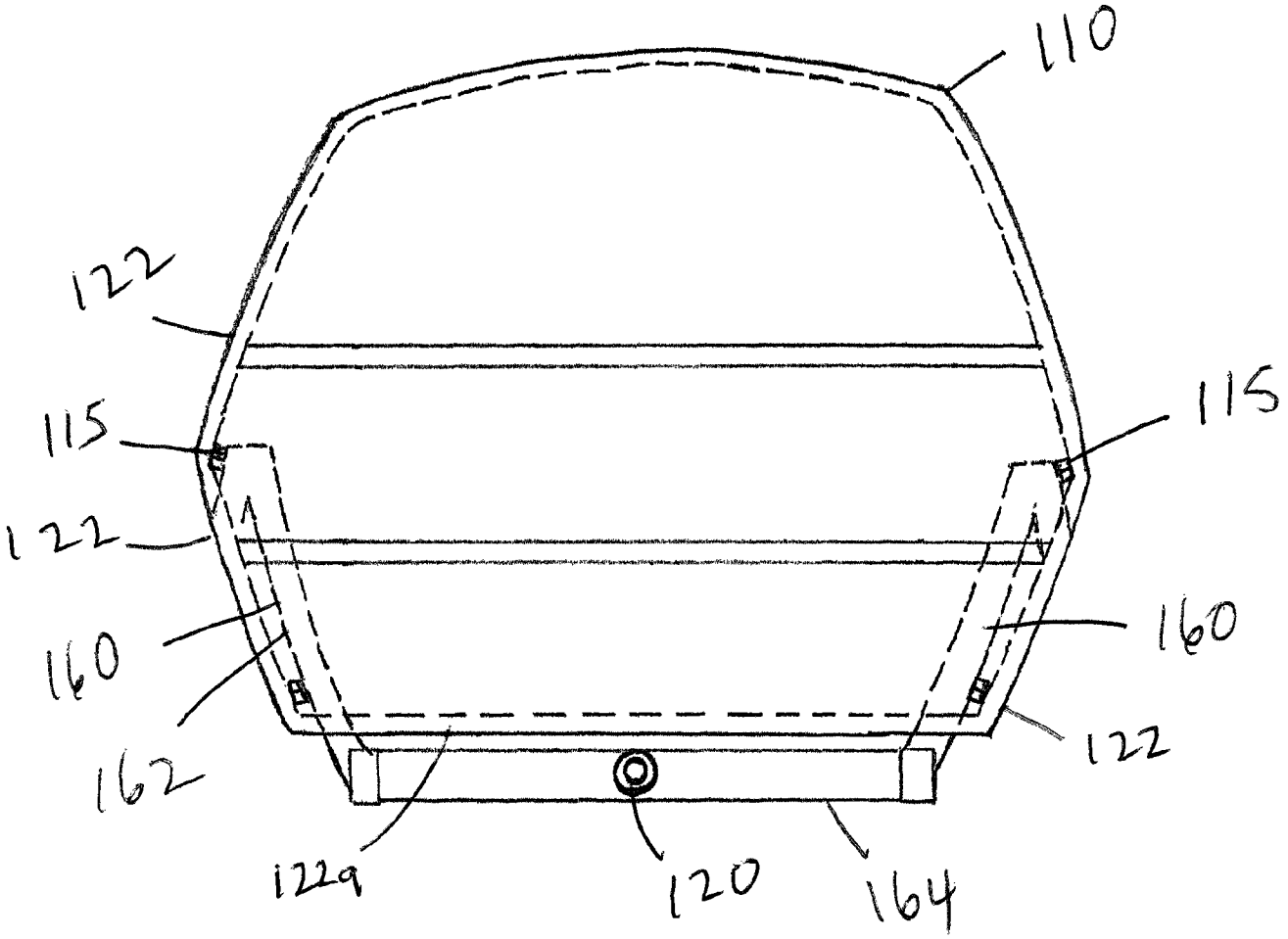
FIG. 7*a* is a top view of FIG. 7.
Figure 7B:
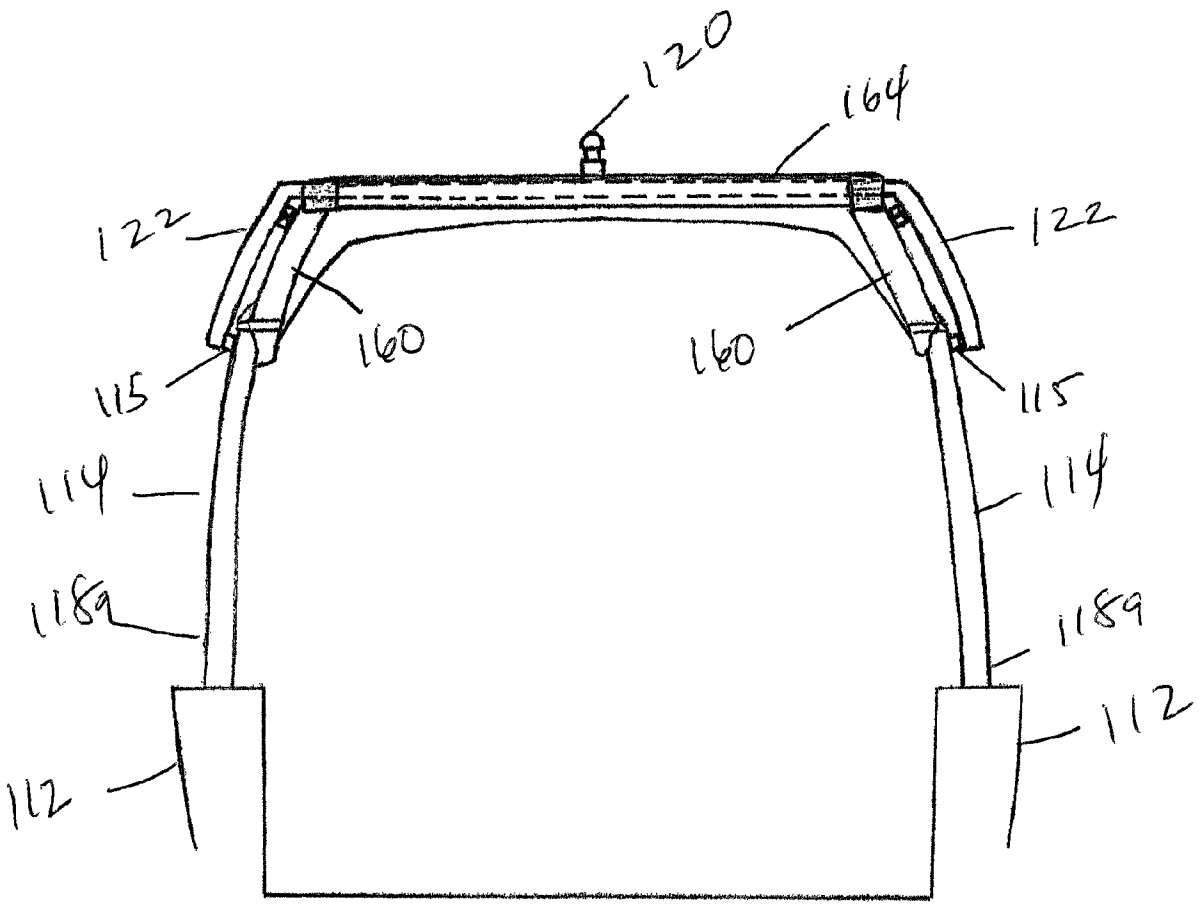
FIG. 7*b* is a rear view of FIG. 7.
Figure 8:
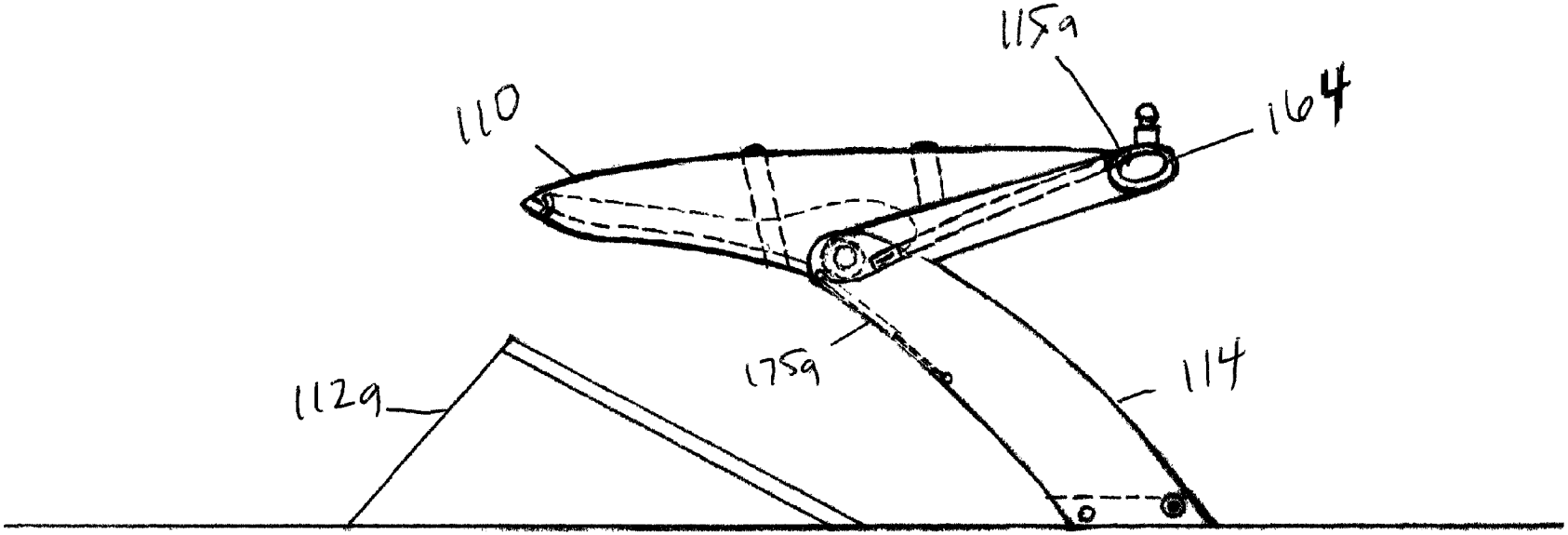
FIG. 8 is a side view of a second alternate embodiment of the instant invention.
Figure 9:
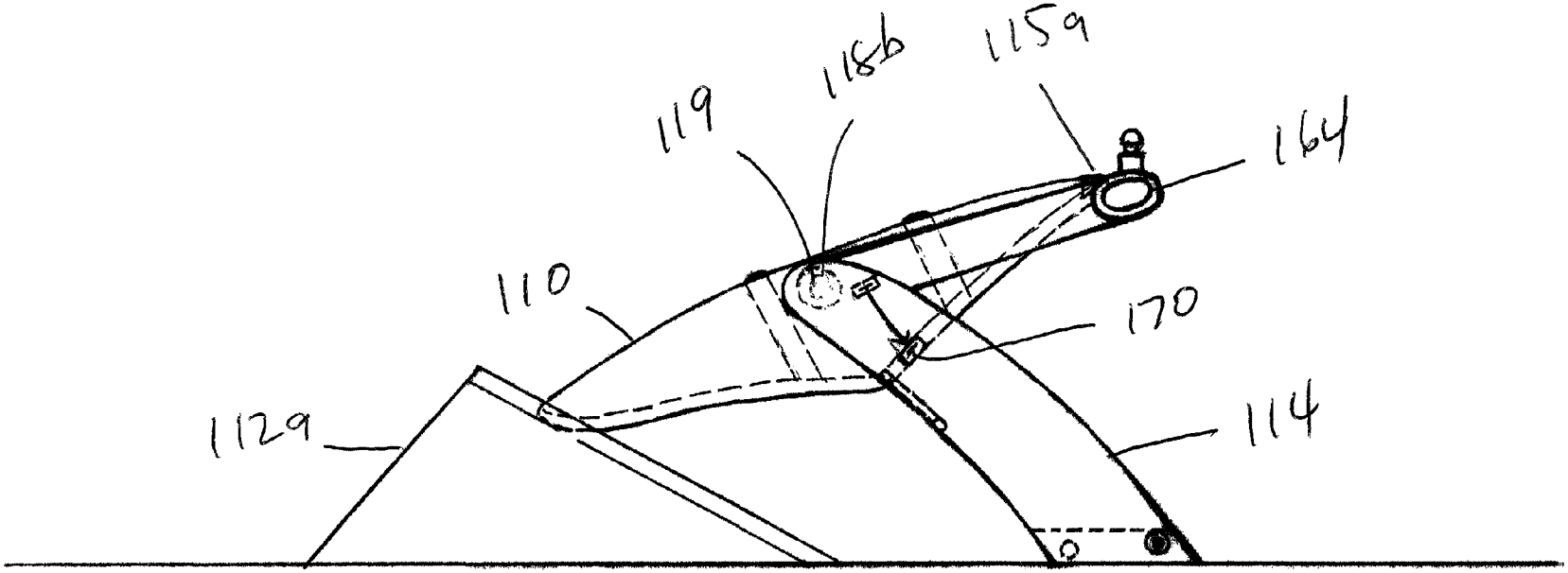
FIG. 9 is a side view of FIG. 8 with the cargo rack tilted down.
Figure 10:
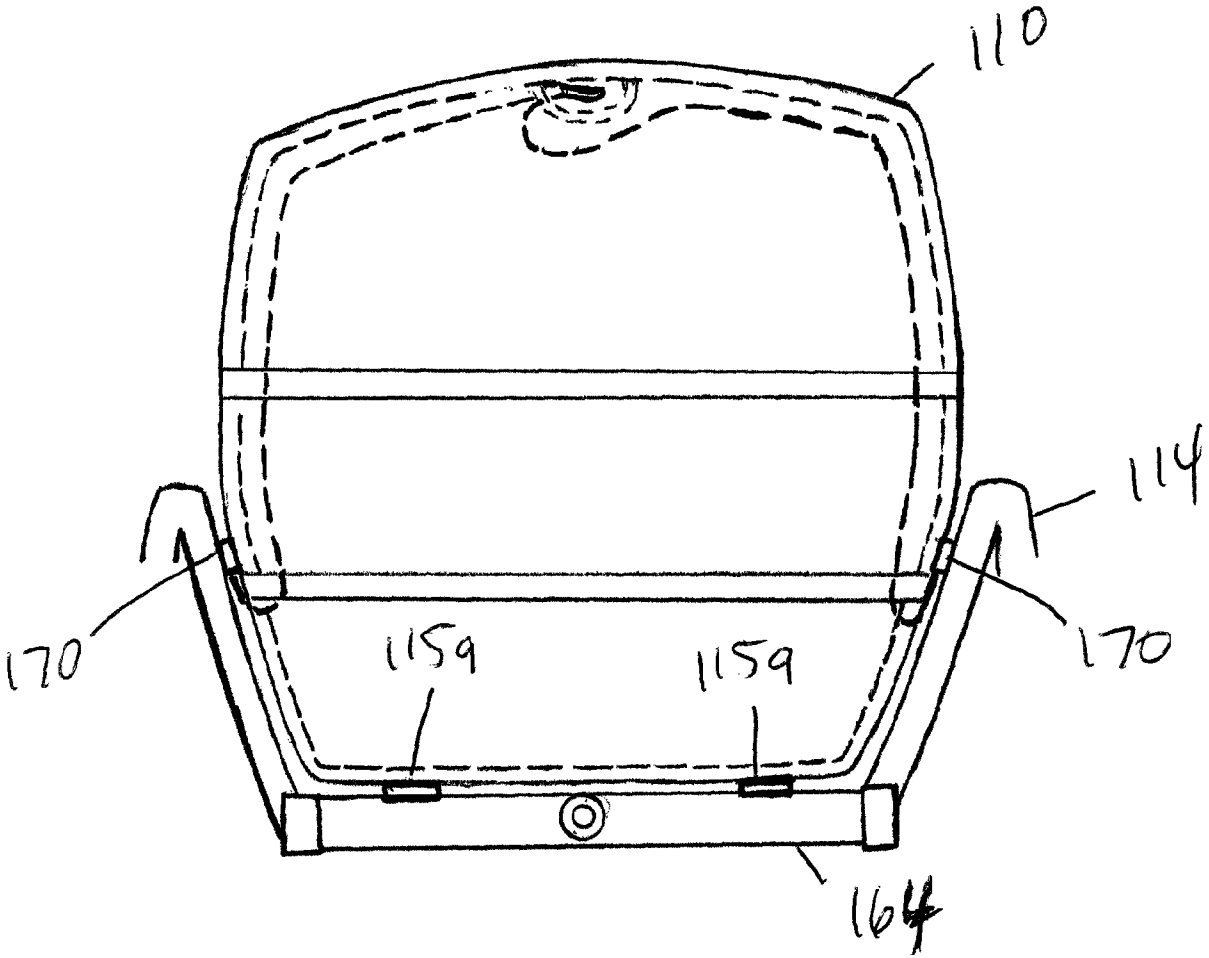
FIG. 10 is a top view of FIG. 8.
Figure 11:
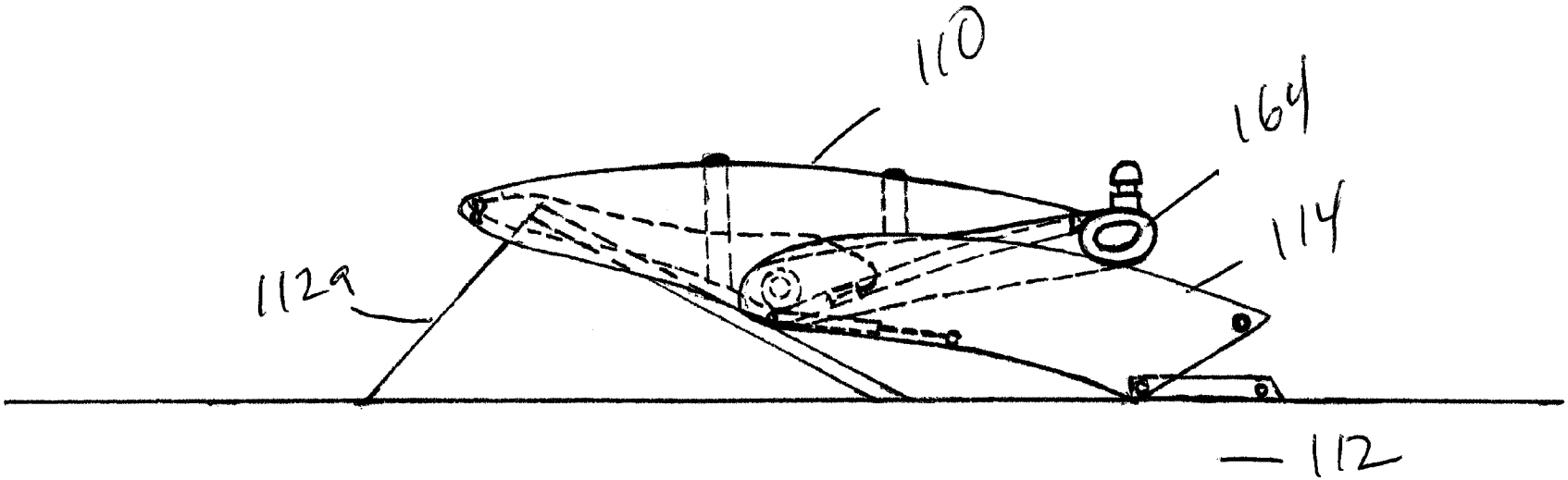
FIG. 11 is a side view of FIG. 8 with the cargo rack and tower folded down.

As shown at least in FIG. 7-FIG. 7*b*, the First Alternate embodiment of the height adjustable cargo rack apparatus and tower 100 of the instant invention further includes a cargo rack apparatus 110 supported by the upper ends of both the forward vertical support 116 and the aft vertical support 118 near a midsection 119 of each tower 114 [such as the cargo rack of U.S. Pat. No. 8,297,484 which is incorporated herein by reference] as disclosed in the Preferred Embodiment above.

In this embodiment the one or more peripheral rail 122 of the cargo rack apparatus 110 extends outboard of each tower 114 thereby surrounding each tower 114.

In this embodiment the one or more peripheral rail 122 of the cargo rack apparatus 110 pivots about cargo rack pivot point connector(s) 115 near the midsection 119 of each tower 114. The cargo rack pivot point connector(s) 115 are positioned on the two towers 114 outside the area bounded by the two towers 114 and the one or more peripheral rail 122 is includes a portion 122*a* which extends approximate the upper tower section back wall 164.

Height Adjustable Cargo Rack Second Alternate Embodiment

As shown at least in FIG. 8-FIG. 11 of the this alternate embodiment, the height adjustable cargo rack apparatus and tower of the instant invention further includes a cargo rack apparatus 110 supported by the upper tower section 160, such as by the upper tower section back wall 164. In this embodiment the cargo rack extends inboard of each tower 114.

In this embodiment the cargo rack apparatus 110 pivots about cargo rack pivot point connector(s) 115*a* positioned on the upper tower section back wall 164.

The arrangement allows the cargo rack apparatus 110 to swing within the area bounded by the two towers 114.

Height Adjustable Cargo Rack Third Alternate Embodiment

Figure 12:
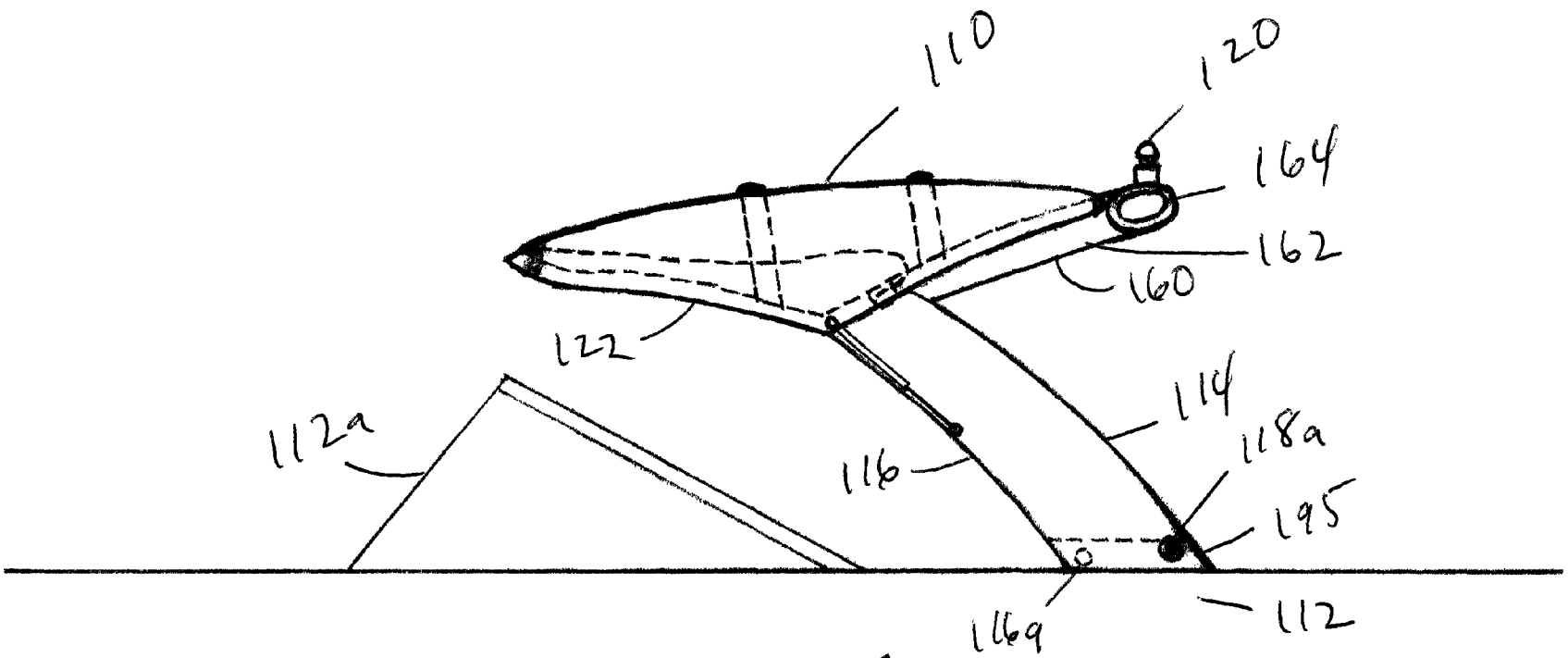
FIG. 12 is a side view of a third alternate embodiment of the instant invention.
Figure 12A:
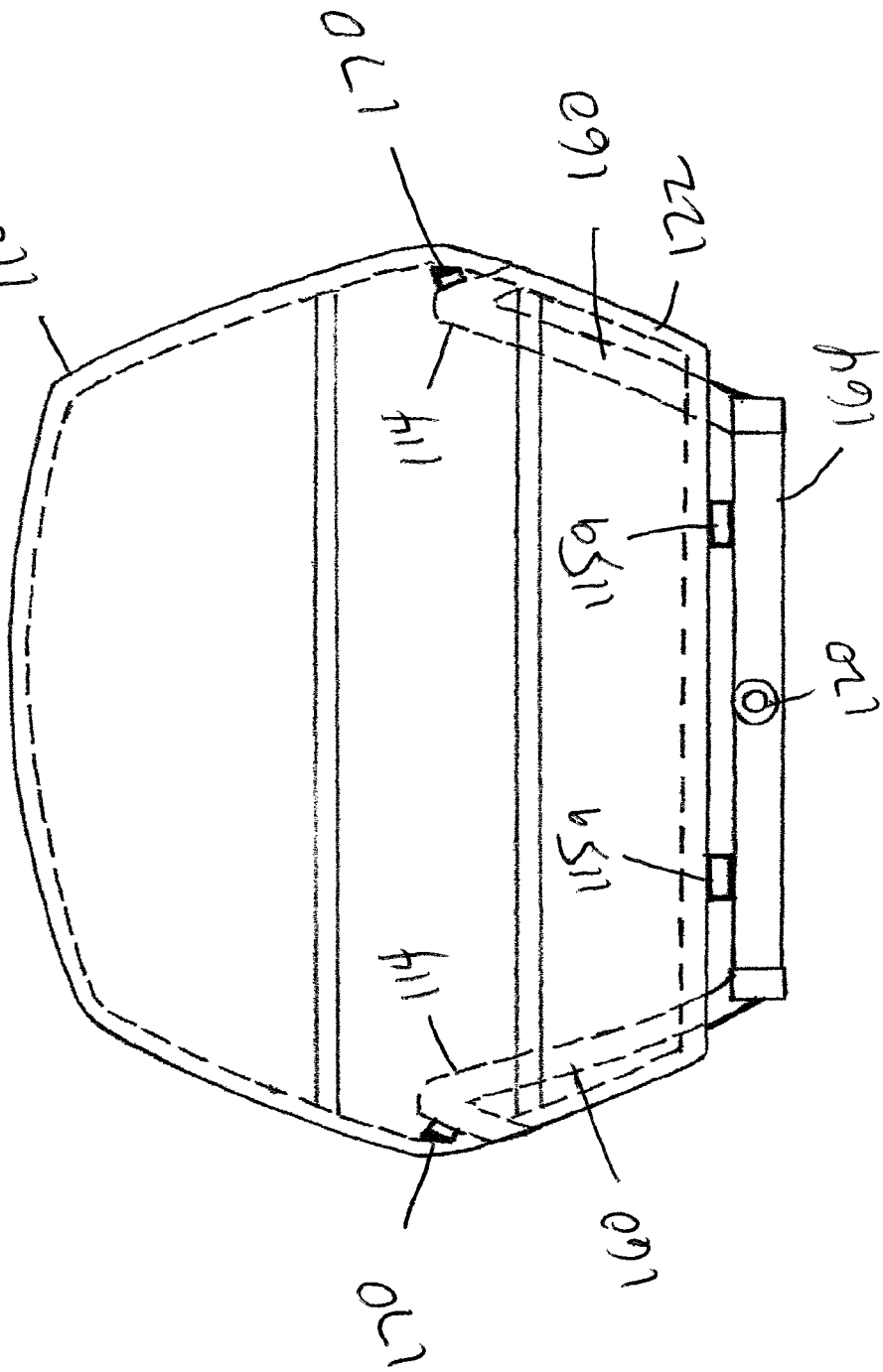
FIG. 12*a* is a top view of FIG. 12.
Figure 12B:
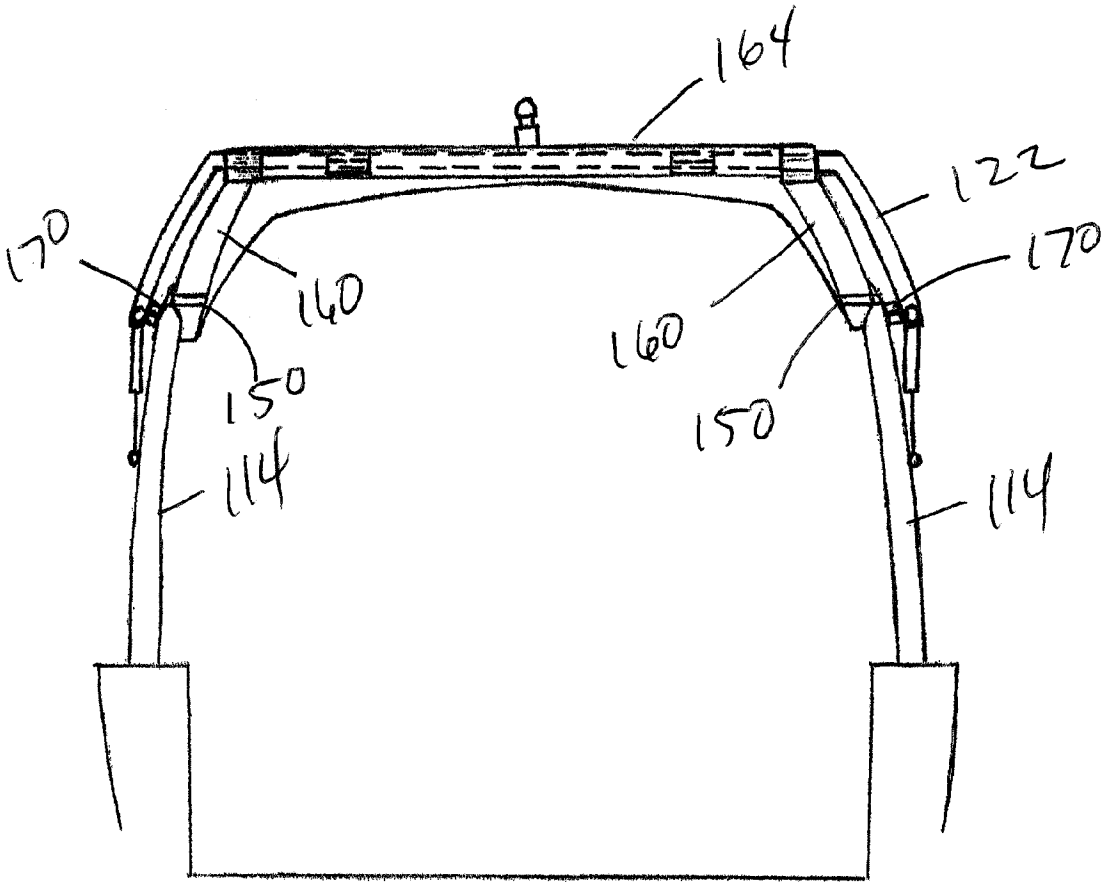
FIG. 12*b* is a rear view of FIG. 12.

As shown at least in FIG. 12-FIG. 12*b* of this alternate embodiment, the height adjustable cargo rack apparatus and tower of the instant invention further includes a cargo rack apparatus 110 supported by the upper tower section 160, such as by the upper tower section back wall 164.

In this embodiment the one or more peripheral rail 122 of the cargo rack apparatus 110 extends outboard of each tower 114 thereby surrounding each tower 114.

Height Adjustable Cargo Rack Fourth Alternate Embodiment

Figure 12C:
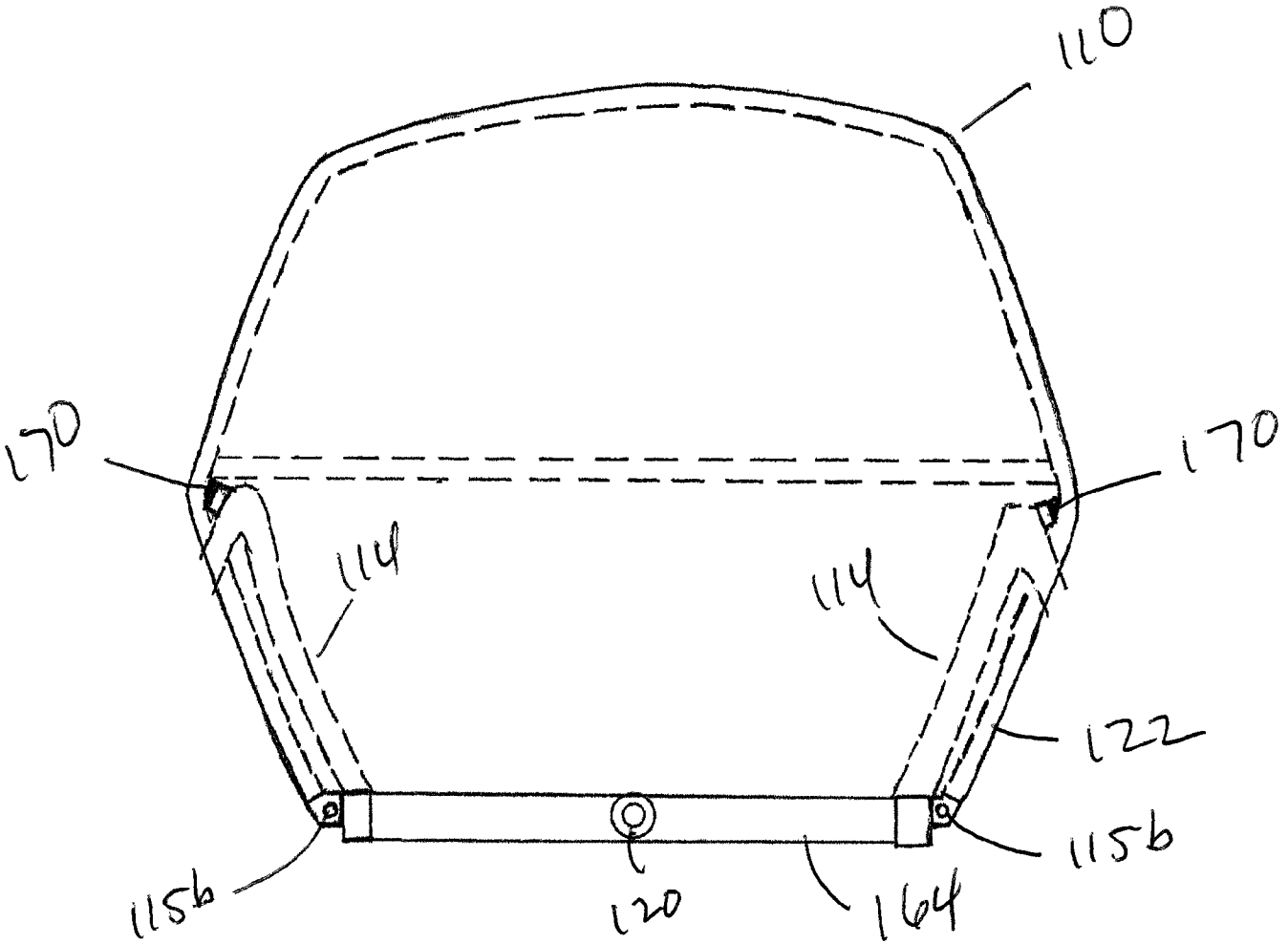
FIG. 12*c* is a top view of a fourth alternate embodiment of the instant invention.
Figure 12D:
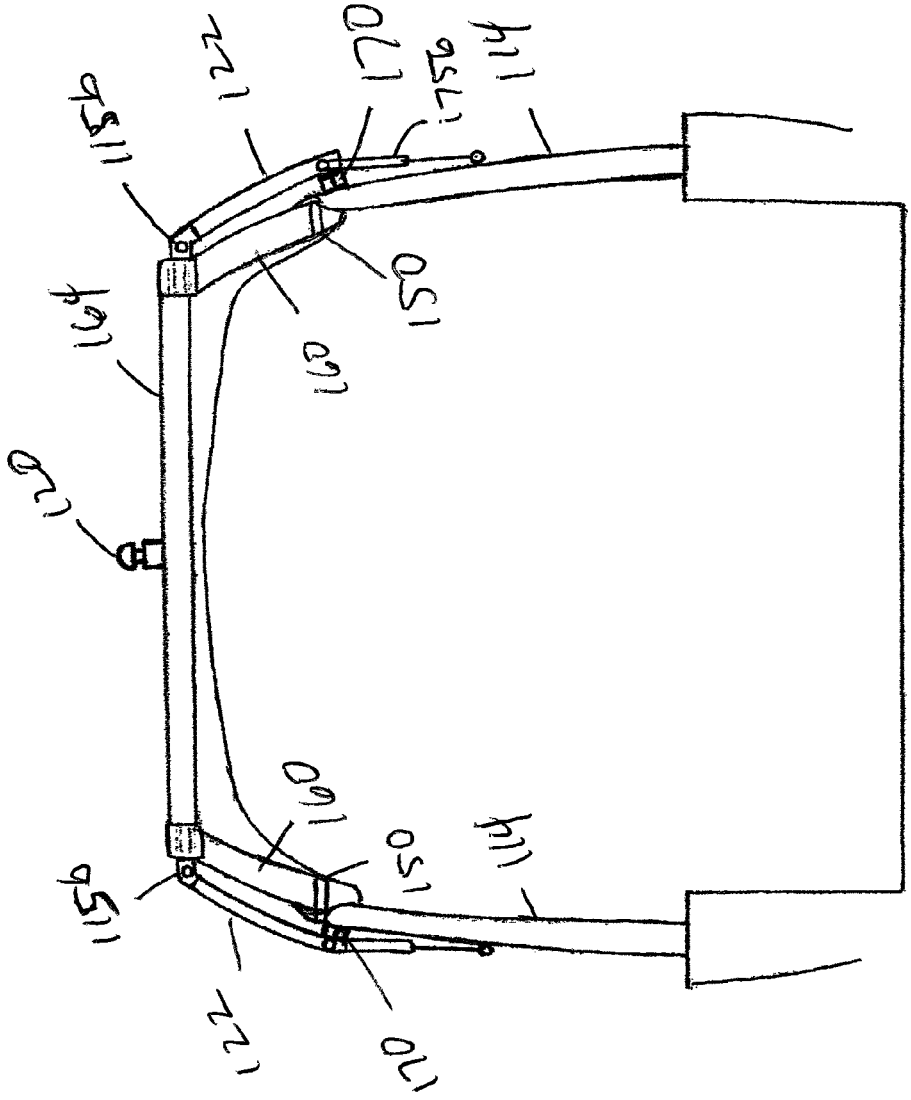
FIG. 12*d* is a rear view of FIG. 12*c*.

As shown at least in FIG. 12*c*-FIG. 12*d* of the preferred embodiment, the height adjustable cargo rack apparatus and tower of the instant invention further includes a cargo rack apparatus 110 supported by the upper tower section 160, such as by cargo rack pivot point connector(s) 115*b* provide at outward of the upper tower section back wall 164. In this embodiment the cargo rack extends outboard of each tower 114 and does not include a peripheral rail adjacent the upper tower section back wall 164.

In this embodiment the one or more peripheral rail 122 of the cargo rack apparatus 110 extends outboard of each tower 114 thereby surrounding each tower 114 while extending forward from the upper tower section back wall 164.

Height Adjustable Tow Point

A ski tow 120 is provided on the upper tower section back wall 164 the height of the ski tow 120 is adjustable as such as the height adjustment of the ski tow of U.S. Pat. No. 8,297,484 which is incorporated herein by reference.

Tow Point Height Adjustment Operation

The upper tower section side walls 162, 166 of the tower can be raised and lowered, which in effect changes the height of the ski tow 120 and consequently changes the height a tow rope (not shown) attached to the ski tow 120 and thereby adjusts the towing point height.

The instant invention allows for the adjustment of the rake or angle of the cargo rack apparatus 110 with respect to the upper tower section 160 and its interconnected peripheral rails.

This adjustability allows, for example, the boater to position the tow point (120) at the maximum height position so that wake boarders get higher in the air when doing maneuvers while also positioning the cargo rack apparatus 110 in the lowest position with the front wall 124 closest to the boat deck to simultaneously provide boat passengers maximum coverage from the sun, wind, and rain thereby enhancing the boating experience for all participants.

FIGS. provided herein presents the height adjustable cargo rack apparatus and tower 100 of the instant invention in various positions as it transitions from the fully extended position shown in FIG. 1 to the fully retracted position as shown in FIG. 6. Further, the height of the cargo rack apparatus 110 varies independently of the height of the upper section 160 through at least a portion of the transition. This allows users to independently vary the tower height (and thereby the cargo rack apparatus 110 height), vary the cargo rack apparatus 110 rake or pitch angle, and/or vary the rake or pitch angle of the upper tower section 160 (and thereby adjust the ski tow attachment point).

The foregoing disclosure is sufficient to enable one having skill in the art to practice the invention without undue experimentation, and provides the best mode of practicing the invention presently contemplated by the inventor. While there is provided herein a full and complete disclosure of the preferred embodiments of this invention, it is not intended to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Accordingly, the proper scope of the present invention should be determined only by the broadest interpretation of the appended claims so as to encompass all such modifications as well as all relationships equivalent to those illustrated in the drawings and described in the specification.

The invention claimed is:

1. A height adjustable cargo rack apparatus and tower, the tower including at least one port vertical support interconnected to at least one starboard vertical support, each vertical support including an upper end and a lower end, said apparatus comprising:

a cargo rack member providing storage; and a plurality of connectors releasably suspending said cargo rack member about said vertical supports of the boat tower, wherein said cargo rack member is removably and pivotally attached to the interconnection of each said port and starboard vertical supports, and wherein said cargo rack member can tilt upward or downward about said vertical support attachments for access to stored equipment.

2. The cargo rack of claim 1 wherein said cargo rack member comprises at least one peripheral rail defining an interior volume.

3. A height adjustable cargo rack apparatus and boat tower, the boat tower including at least one port vertical support interconnected to at least one starboard vertical support, each vertical support including an upper end and a lower end, said apparatus comprising:

a cargo rack member providing storage and having at least one peripheral rail defining an interior volume;

a plurality of connectors releasably suspending said cargo rack member about said vertical supports of said boat tower, wherein said cargo rack member is removably attached to each of said port and starboard vertical supports, and wherein said cargo rack member can tilt or pivot for access to stored equipment;

said apparatus further comprising an upper tower section supported by the upper ends of both said vertical supports, wherein said upper tower section comprises; a port side wall pivotally connected to said port vertical tower support, a starboard side wall pivotally connected to said starboard side vertical tower support, and a back wall interconnecting said port side wall with said starboard side wall, and wherein said upper tower section is pivotally connected to each said port and starboard vertical supports.

4. The apparatus of claim 3 wherein said cargo rack pivots fore and aft about a location near the interconnection of said vertical supports of the tower and the upper tower section at the upper ends of said vertical supports of the tower.

5. The apparatus of claim 4 wherein said at least one peripheral rail of the cargo rack fits within an area bounded by the vertical supports of the tower.

6. The apparatus of claim 5 wherein said cargo rack at least one peripheral rail fits within an area bounded by the upper tower section.

7. The apparatus of claim 5 wherein said cargo rack pivot is positioned aligned with the interconnection of said vertical supports of the tower and the upper tower section at the upper ends of said vertical supports of the tower.

8. The apparatus of claim 5 wherein said cargo rack pivot is positioned below the interconnection of said vertical supports of the tower and the upper tower section at the upper ends of said vertical supports of the tower.

9. The apparatus of claim 5 wherein said cargo rack pivot is positioned above the interconnection of said vertical supports of the tower and the upper tower section at the upper ends of said vertical supports of the tower.

10. The apparatus of claim 5 wherein said cargo rack at least one peripheral rail fits within an area bounded by the back wall of said upper tower section.

11. The apparatus of claim 6 wherein a majority said at least one peripheral rail of said cargo rack extends forward of said back wall of said upper tower section.

12. The apparatus of claim 3 wherein said cargo rack pivots fore about a location near the interconnection of said vertical supports of the tower and the upper tower section at the upper ends of said vertical supports of the tower, wherein said cargo rack at least one peripheral rail fits outside an area bounded by the vertical supports of the tower and outside an area bounded by the upper tower section port and starboard side walls and within an area bounded by the upper tower section back wall.

13. The apparatus of claim 12 wherein said cargo rack pivot is positioned aligned with the interconnection of said vertical supports of the tower and the upper tower section at the upper ends of said vertical supports of the tower.

14. The apparatus of claim 12 wherein said cargo rack pivot is positioned below the interconnection of said vertical supports of the tower and the upper tower section at the upper ends of said vertical supports of the tower.

15. The apparatus of claim 12 wherein said cargo rack pivot is positioned above the interconnection of said vertical supports of the tower and the upper tower section at the upper ends of said vertical supports of the tower.

16. The apparatus of claim 3 wherein said cargo rack tilts or pivots fore about a location on the upper tower section back wall.

17. The apparatus of claim 16 wherein said cargo rack at least one peripheral rail fits within an area bounded by the upper tower section.

18. The apparatus of claim 16 wherein said cargo rack at least one peripheral rail fits outside an area bounded by the vertical supports of the tower and outside an area bounded by the side walls of the upper tower section and within an area bounded by the upper tower section back wall.

19. The apparatus of claim 16 wherein said at least one peripheral rail of the cargo rack fits outside an area bounded by the vertical supports of the tower and outside an area bounded the side walls of the upper tower section.

20. A height adjustable cargo rack apparatus and boat tower, the boat tower including at least one port vertical support interconnected to at least one starboard vertical support, each vertical support including an upper end and a lower end, said apparatus comprising:

a cargo rack member providing storage and having at least one peripheral rail defining an interior volume;

a plurality of connectors releasably suspending said cargo rack member about said vertical supports of said boat tower, wherein said cargo rack member is removably attached to each of said port and starboard vertical supports, said apparatus further comprising an upper tower section supported by the upper ends of both said vertical supports, and wherein said upper tower section comprises; a port side wall pivotally connected to said port vertical tower support, a starboard side wall pivotally connected to said starboard side vertical tower support, and a back wall interconnecting said port side wall with said starboard side wall wherein said upper tower section is pivotally connected to each said port and starboard vertical supports.

* * * * *